US010465478B2

(12) United States Patent
Anton et al.

(10) Patent No.: US 10,465,478 B2
(45) Date of Patent: Nov. 5, 2019

(54) TOE VALVE

(71) Applicant: Tercel Oilfield Products USA LLC, Houston, TX (US)

(72) Inventors: Kenneth J. Anton, Brenham, TX (US); Michael J. Harris, Houston, TX (US)

(73) Assignee: Tercel Oilfield Products USA LLC, Houston, TX (US)

( * ) Notice: Subject to any disclaimer, the term of this patent is extended or adjusted under 35 U.S.C. 154(b) by 95 days.

(21) Appl. No.: 15/687,084

(22) Filed: Aug. 25, 2017

(65) Prior Publication Data

US 2019/0063183 A1 Feb. 28, 2019

(51) Int. Cl.

| | |
|---|---|
| ***E21B 34/10*** | (2006.01) |
| ***E21B 34/06*** | (2006.01) |
| *E21B 33/14* | (2006.01) |
| *E21B 43/14* | (2006.01) |
| *E21B 43/26* | (2006.01) |
| *E21B 34/00* | (2006.01) |

(52) U.S. Cl.

CPC ..... *E21B 34/102* (2013.01); *E21B 34/063* (2013.01); *E21B 34/10* (2013.01); *E21B 34/103* (2013.01); *E21B 33/14* (2013.01); *E21B 43/14* (2013.01); *E21B 43/26* (2013.01); *E21B 2034/007* (2013.01)

(58) Field of Classification Search

CPC ..... E21B 34/102; E21B 34/103; E21B 34/10; E21B 34/063; E21B 2034/007; E21B 33/14; E21B 43/14; E21B 43/26

See application file for complete search history.

(56) References Cited

U.S. PATENT DOCUMENTS

| | | | |
|---|---|---|---|
| 5,819,853 | A | 10/1998 | Patel |
| 6,286,594 | B1 | 9/2001 | French |
| 6,834,726 | B2 | 12/2004 | Giroux et al. |
| 8,267,178 | B1 | 9/2012 | Sommers et al. |
| 8,555,960 | B2 | 10/2013 | Mailand et al. |
| 8,863,853 | B1 | 10/2014 | Harris et al. |
| 8,915,300 | B2 | 12/2014 | Sommers et al. |
| 9,004,180 | B2 | 4/2015 | Jackson |
| 9,121,247 | B2 | 9/2015 | George et al. |
| 9,121,251 | B2 | 9/2015 | Sommers et al. |
| 9,121,252 | B2 | 9/2015 | George et al. |
| 9,133,684 | B2 | 9/2015 | Hofman et al. |
| 9,273,535 | B1 | 3/2016 | George et al. |
| 9,359,864 | B2 | 6/2016 | Harris et al. |

(Continued)

FOREIGN PATENT DOCUMENTS

WO 2015/088762 A1 6/2015

OTHER PUBLICATIONS

Schlumberger, *KickStart Rupture Disc Valve* (Copyright 2016).

(Continued)

*Primary Examiner* — Brad Harcourt

(74) *Attorney, Agent, or Firm* — Keith B. Willhelm

(57) ABSTRACT

A valve has a valve body which includes a sub. A bore extends through the valve body and the sub. The valve also comprises a port and a sleeve. The sleeve is mounted for hydraulic displacement. There is a passage through the sleeve which is in fluid communication with the bore. The sleeve is moveable in response to fluid pressure from the bore through the passage. The sleeve is moveable from a closed position, in which it restricts flow out of the bore through the port, to an open position, in which it allows flow out of the bore through the port.

24 Claims, 4 Drawing Sheets

(56) References Cited

U.S. PATENT DOCUMENTS

| | | | |
|---|---|---|---|
| 9,359,865 | B2 | 6/2016 | Mailand et al. |
| RE46,137 | E | 9/2016 | Jason et al. |
| 9,441,440 | B2 | 9/2016 | Hofman et al. |
| 9,441,467 | B2 | 9/2016 | Harris et al. |
| 9,458,698 | B2 | 10/2016 | Harris et al. |
| 9,476,282 | B2 | 10/2016 | Anton et al. |
| 9,567,832 | B2 | 2/2017 | Hofman et al. |
| 9,611,719 | B2 | 4/2017 | Hofman et al. |
| 9,650,866 | B2 | 5/2017 | George et al. |
| 9,664,008 | B2 | 5/2017 | Kippola et al. |
| 9,835,010 | B2 | 12/2017 | Anton et al. |
| 9,896,908 | B2 | 2/2018 | Harris et al. |
| 9,915,122 | B2 | 3/2018 | Hofman et al. |
| 9,976,386 | B2 | 5/2018 | Harris et al. |
| 10,030,474 | B2 | 7/2018 | Themig et al. |
| 10,066,461 | B2 | 9/2018 | Hardesty et al. |
| 10,107,072 | B2 | 10/2018 | Harris et al. |
| 10,107,076 | B2 | 10/2018 | Muscroft et al. |
| 10,138,725 | B2 | 11/2018 | George et al. |
| 10,174,590 | B2 | 1/2019 | Kellner |
| 10,184,308 | B2 | 1/2019 | Chauffe et al. |
| 2005/0126787 | A1 | 6/2005 | Gomez |
| 2011/0100643 | A1 | 5/2011 | Themig et al. |
| 2013/0025872 | A1 | 12/2013 | Mailand et al. |
| 2014/0374096 | A1 | 12/2014 | Anton et al. |
| 2015/0184489 | A1 | 7/2015 | Resweber |
| 2015/0369040 | A1 | 12/2015 | George et al. |
| 2016/0168949 | A1 | 6/2016 | Anton et al. |
| 2016/0177667 | A1 | 6/2016 | Kellner et al. |

OTHER PUBLICATIONS

*International Search Report*, PCT Ser. No. PCT/US2018/047828 (EPO dated Nov. 7, 2018).

*Written Opinion of the Int'l Search Authority*, PCT Ser. No. PCT/US2018/047828 (EPO dated Nov. 7, 2018).

TOE VALVE

FIELD OF THE INVENTION

The present invention relates to valves used in oil and gas well drilling operations and, and more particularly, to valves suitable for initiating fracturing and other stimulation operations in an oil and gas well.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer. Thus, the porous layer forms a reservoir, that is, a volume in which hydrocarbons accumulate. A well is drilled through the earth until the hydrocarbon bearing formation is reached. Hydrocarbons then are able to flow from the porous formation into the well.

In what is perhaps the most basic form of rotary drilling methods, a drill bit is attached to a series of pipe sections or "joints" referred to as a drill string. The drill string is suspended from a derrick and rotated by a motor in the derrick. A drilling fluid or "mud" is pumped down the drill string, through the bit, and into the bore of the well. This fluid serves to lubricate the bit. The drilling mud also carries cuttings from the drilling process back to the surface as it travels up the wellbore. As the drilling progresses downward, the drill string is extended by adding more joints of pipe.

A modern oil well typically includes a number of tubes extending wholly or partially within other tubes. That is, a well is first drilled to a certain depth. Large diameter pipes, or casings, are placed in the well and cemented in place to prevent the sides of the borehole from caving in. The casing is cemented in the well by injecting a cement slurry down the casing, out the bottom of the casing, and up into the gap between the casing and the bore of the well, that is, the annulus. The cement then is allowed to harden into a continuous seal throughout the annulus.

After the initial section has been drilled, cased, and cemented, drilling will proceed with a somewhat smaller wellbore. The smaller bore is lined with somewhat smaller pipes or "liners." The liner is suspended from the original or "host" casing by an anchor or "hanger." A well may include a series of smaller liners, and May extend for many thousands of feet, commonly up to and over 25,000 feet.

Hydrocarbons, however, are not always able to flow easily from a formation to a well. Some subsurface formations, such as sandstone, are very porous. Hydrocarbons are able to flow easily from the formation into a well. Other formations, however, such as shale rock, limestone, and coal beds, are only minimally porous. The formation may contain large quantities of hydrocarbons, but production through a conventional well may not be commercially practical because hydrocarbons flow though the formation and collect in the well at very low rates. The industry, therefore, relies on various techniques for improving the well and stimulating production from formations. In particular, various techniques are available for increasing production from formations which are relatively nonporous.

Perhaps the most important stimulation technique is the combination of horizontal wellbores and hydraulic fracturing. A well will be drilled vertically until it approaches a formation. It then will be diverted, and drilled in a more or less horizontal direction, so that the borehole extends along the formation instead of passing through it. More of the formation is exposed to the borehole, and the average distance hydrocarbons must flow to reach the well is decreased. Fractures then are created in the formation which will allow hydrocarbons to flow more easily from the formation.

Fracturing a formation is accomplished by pumping fluid, most commonly water, into the well at high pressure and flow rates. Proppants, such as grains of sand, ceramic or other particulates, usually are added to the fluid along with gelling agents to create a slurry. The slurry is forced into the formation at rates faster than can be accepted by the existing pores, fractures, faults, vugs, caverns, or other spaces within the formation. Pressure builds rapidly to the point where the formation fails and begins to fracture. Continued pumping of fluid into the formation will tend to cause the initial fractures to widen and extend further away from the wellbore, creating flow paths to the well. The proppant serves to prevent fractures from closing when pumping is stopped.

A formation rarely will be fractured all at once. It typically will be fractured in many different locations or zones and in many different stages. Fluids will be pumped into the well to fracture the formation in a first zone. After the initial zone is fractured, pumping is stopped, and a plug is installed in the liner at a point above the fractured zone. Pumping is resumed, and fluids are pumped into the well to fracture the formation in a second zone located above the plug. That process is repeated for zones further up the formation until the formation has been completely fractured.

Fracturing typically involves installing a production liner in the portion of the wellbore passing through the hydrocarbon bearing formation. The production liner may incorporate valves, typically sliding sleeve "ball-drop" valves. The valve may be actuated by deploying a ball into the valve to open ports in the valve and to plug its bore. The ball restricts flow through the liner and diverts fluid through the ports and into the formation. Once fracturing is complete various operations will be performed to remove the balls and allow fluids from the formation to enter the liner and travel to the surface.

In many wells, however, the production liner does not incorporate valves. Instead, fracturing will be accomplished by "plugging and perfing" the liner. In a "plug and perf" job, the production liner is made up from standard joints of liner. The liner does not have any openings through its sidewalls, nor does it incorporate frac valves. It is installed in the wellbore, and holes then are punched in the liner walls. The perforations typically are created by so-called "perf" guns which discharge shaped charges through the liner and, if present, adjacent cement.

Regardless of whether it incorporates frac valves or will be perforated, a production liner typically will include a valve which is used to establish fractures in a first zone near the bottom of the well. Such "initiator" or "toe" valves are assembled into the liner. Though not necessarily the only design, one common type of toe valve has a hydraulically actuated sliding sleeve. The toe valve is run into the well with the sleeve in a closed position. In its closed position, the sleeve prevents fluid from flowing out of the liner through the valve ports. Hydraulic pressure may be applied to the sleeve to move it to an open position in which the ports are open and fluid is able to flow out of the liner into the formation.

As noted, a production liner typically will be cemented in the bore before fracturing is started. That generally entails pumping cement through the toe valve. Cement left behind in a toe valve, however, can harden and create various issues. It may hinder or preclude movement of the sleeve. Cement also can plug ports and other passages in the valve, interfering with operation of the valve or flow out of the valve. Cement wiper plugs typically are deployed behind the cement slurry to wipe inner surfaces clean. They are not always effective in removing cement, however, especially when the interior surfaces of the toe valve are highly profiled. Thus, there are various designs for so-called "smooth bore" toe valves.

On such design is disclosed in U.S. Pat. No. 9,476,282 to K. Anton et al. The toe valves disclosed therein include a pair of cylindrical primary structural components or "subs." The subs are coupled together and spaced apart by a cylindrical housing. A sleeve is hydraulically mounted radially between the housing and the subs. An aperture is provided in one of the subs. The aperture allows fluid to flow into a hydraulic chamber above the sleeve. The aperture is normally closed by a pressure device, such as a rupture disc. As pressure increases within the bore, the disc will rupture and fluid will flow into the chamber. The fluid entering the chamber will drive the sleeve, moving it from its closed to its open position and allowing fluid to flow out of the valve.

It will be appreciated, however, that the aperture is exposed to cement fluid flowing through the valve during a cement job. Cement may harden in the aperture and block flow through the aperture or interfere with operation of the rupture disc. For example, if cement sets in or over the rupture disc, it may not burst at its rated pressure. Pressure in the liner may have to be raised, possibly beyond the liner's pressure rating, in order to rupture the disc and actuate the toe valve.

The statements in this section are intended to provide background information related to the invention disclosed and claimed herein. Such information may or may not constitute prior art. It will be appreciated from the foregoing, however, that there remains a need for new and improved systems, apparatus, and methods for initiating fracturing and other stimulation operations in an oil and gas well. Such disadvantages and others inherent in the prior art are addressed by various aspects and embodiments of the subject invention.

SUMMARY OF THE INVENTION

The subject invention relates generally to valves suitable for initiating fracturing and other stimulation operations in an oil and gas well and encompasses various embodiments and aspects, some of which are specifically described and illustrated herein. One broad embodiment of the invention provides for toe valves comprising a bore, a first sub, a second sub, a housing, and a sleeve. The bore extends through the valve. The first and second subs have inner ends. The housing has a port. It couples the first and second subs such that the inner ends of the subs are spaced apart axially and the housing is spaced radially from the inner ends of the subs. The sleeve is mounted for hydraulic displacement in the radial space between the housing and the inner ends of the subs. The sleeve also has a passage extending through it. The passage is in fluid communication with the bore through the axial space between the inner ends of the subs. The sleeve is moveable in response to fluid pressure from the bore through the passage. The sleeve is movable from a closed position, in which it restricts flow out of the bore through the port, to an open position, in which it allows flow out of the bore through the port. In other embodiments, the sleeve passage is covered by the first sub when the sleeve is in the closed position.

Other broad embodiments of the invention provide for toe valves comprising a valve body. The valve body includes a sub. A bore extends through the valve body and the sub. The valve also comprises a port and a sleeve. The sleeve is mounted for hydraulic displacement. There is a passage through the sleeve which is in fluid communication with the bore. The sleeve is moveable in response to fluid pressure from the bore through the passage. The sleeve is moveable from a closed position, in which it restricts flow out of the bore through the port, to an open position, in which it allows flow out of the bore through the port. The passage is covered by the sub when the valve is in its closed position.

Other embodiments provide toe valves where a radial clearance between the sleeve and the first sub provides fluid communication between the sleeve passage and the axial space between the inner ends of the subs.

Still other embodiments provide toe valves where the inner end of each of the first and second subs comprises a portion of reduced outer diameter and wherein the housing is spaced radially outward from the portions of reduced outer diameter. Further embodiments provide toe valves where the inner end of each the first and second subs comprise a portion of a first reduced outer diameter and a portion of a second reduced outer diameter. The housing is coupled to the inner ends of the subs at the portions of first reduced outer diameter and is spaced radially outward from the portions of second reduced outer diameter. Yet other embodiments provide toe valves where the housing couples the subs by threaded connections.

In other aspects and embodiments, the invention provides for valves where the passage through the sleeve is an aperture. Additional embodiments provide valves where the sleeve comprises a pressure release device disposed in the passage or where the pressure release device is a rupture disc, check valve, or pressure relief valve. Still other embodiments provide valves where the pressure release device is covered by the first sub when the sleeve is in its closed position.

Other embodiments provide valves where the sleeve is releasably retained in the open position. En some embodiments, the sleeve is releasably retained in the open position by a lock ring engaging one of the subs and the sleeve or by self-locking tapers.

The subject invention also provides methods of performing well operations, such as fracturing and other stimulation operations. The methods including installing or otherwise providing a liner assembly having a novel toe valve. Hydraulic pressure within the liner assembly is increased to open the toe valve and to discharge fluid from the liner assembly through the valve.

Finally, still other aspects and embodiments of the invention will have various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the way it may be practiced. The subject invention encompasses other embodiments consistent with the claims set forth herein.

BRIEF DESCRIPTION OF TILE DRAWINGS

FIG. 1A is a schematic illustration of a liner assembly 10 being cemented in a bore 4 of a well 1, which liner assembly 10 includes a first preferred embodiment 30 of the toe valves of the subject invention.

FIG. 1B is a schematic illustration of the initial stage of a "plug and perf" fracturing operation showing liner assembly 10 installed and cemented in wellbore 4 and initial fractures 9 created by opening toe valve 30.

FIG. 1C is a schematic illustration of an early stage of the plug and perf fracturing operation which shows a tool string 20 deployed into liner assembly 10, where tool string 20 includes a perf gun 21, a setting tool 22, and a frac plug 23*a*.

FIG. 1D is a schematic illustration of liner assembly 10 after completion of the plug and perf fracturing operation, but before removal of plugs 23 from liner 10.

Figure 1A:
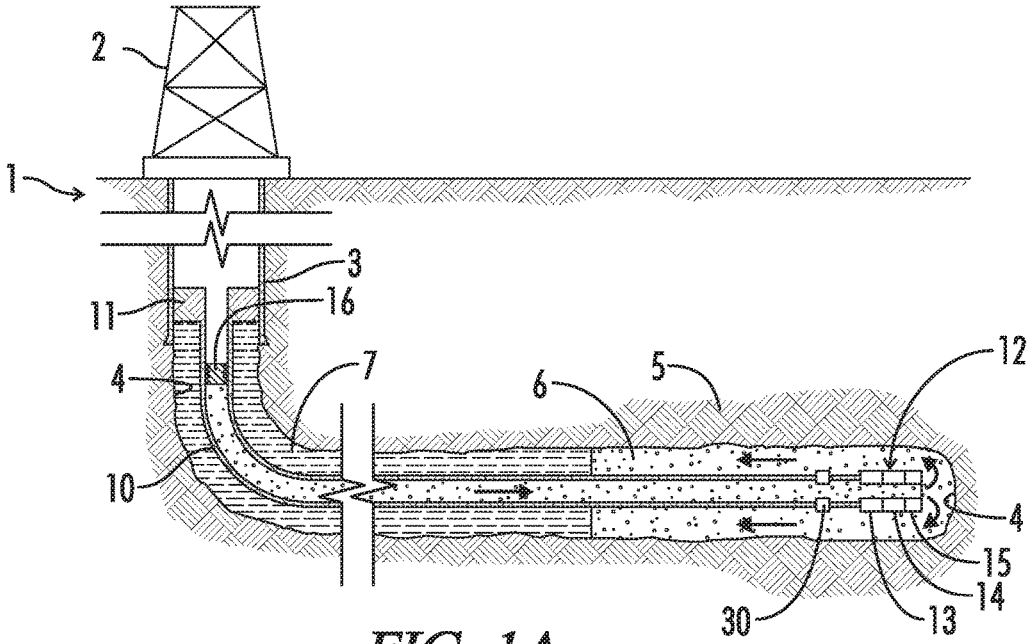

In the drawings and description that follows, like parts are identified by the same reference numerals. The drawing figures are not necessarily to scale. Certain features of the embodiments may be shown exaggerated in scale or in somewhat schematic form and some details of conventional design and construction may not be shown in the interest of clarity and conciseness.

DESCRIPTION OF ILLUSTRATIVE EMBODIMENTS

The subject invention relates generally to toe valves, also referred to as initiator valves, and encompasses various embodiments and aspects. Some of those embodiments are described is some detail herein. For the sake of conciseness, however, all features of an actual implementation may not be described or illustrated. In developing any actual implementation, as in any engineering or design project, numerous implementation-specific decisions must be made to achieve a developers' specific goals. Decisions usually will be made consistent within system-related and business-related constraints, and specific goals may vary from one implementation to another. Development efforts might be complex and time consuming and may involve many aspects of design, fabrication, and manufacture. Nevertheless, it should be appreciated that such development projects would be a routine effort for those of ordinary skill having the benefit of this disclosure.

The novel toe valves may be used to initiate fracturing operations. They also may be used to initiate other stimulation operations. They may be used with a production liner incorporating frac valves or in fracturing a well by plug and perf operations. Broad embodiments of the novel toe valves have a bore extending through the valve, a port, and a sleeve. The sleeve is mounted for hydraulic displacement and has a passage through the sleeve which is in communication with the bore. The sleeve is moveable in response to fluid pressure from the bore through the passage. The sleeve is movable from a closed position to an open position. In the closed position, the sleeve restricts flow out of the bore through the port. In the open position, the sleeve allows flow out of the bore through the port.

Overview of Cementing and Plug and Perf Fracturing Operations

A first preferred toe valve 30, for example, will be described by reference to FIGS. 1-3. As may be seen in the schematic representations of FIG. 1, toe valve 30 may be used to initiate a "plug and perf" fracturing operation in an oil and gas well 1. Referring first to FIG. 1A, well 1 is serviced by a derrick 2 and various surface and downhole equipment for pumping cement and circulating fluids (not shown). The upper portion of well 1 is provided with a casing 3, while the lower portion is an open bore 4 extending generally horizontally through a hydrocarbon bearing formation 5.

A liner assembly 10 has been suspended from casing 3 by a liner hanger 11 and extends through open bore 4. Liner assembly 10 includes various tools, including toe valve 30 and a float assembly 12. Float assembly 12 typically includes various tools that assist in running liner 10 into well 1 and cementing it in bore 4, such as a landing collar 13, a float collar 14, and a float shoe 15.

FIG. 1A depicts well 1 as liner 10 is being cemented in bore 4. A quantity or "plug" of cement 6 is being pumped into liner 10, out its lower end, and into the annulus between liner 10 and bore 4. As cement 6 is pumped, it displaces drilling fluids 7 already present in liner 10 and the annulus. A wiper plug 16 is being pumped behind cement 6. It follows the plug of cement 6 as it flows through liner 10. Wiper plug 13 will help clean and remove cement 6 from the inside of liner 10. It will pass through toe valve 30 and eventually seat on landing collar 13 in float assembly 12. Pumping will continue until cement 6 completely fills the annulus between liner 10 and bore 4. It then will be allowed to set, as seen in FIG. 1B.

Figure 1B:
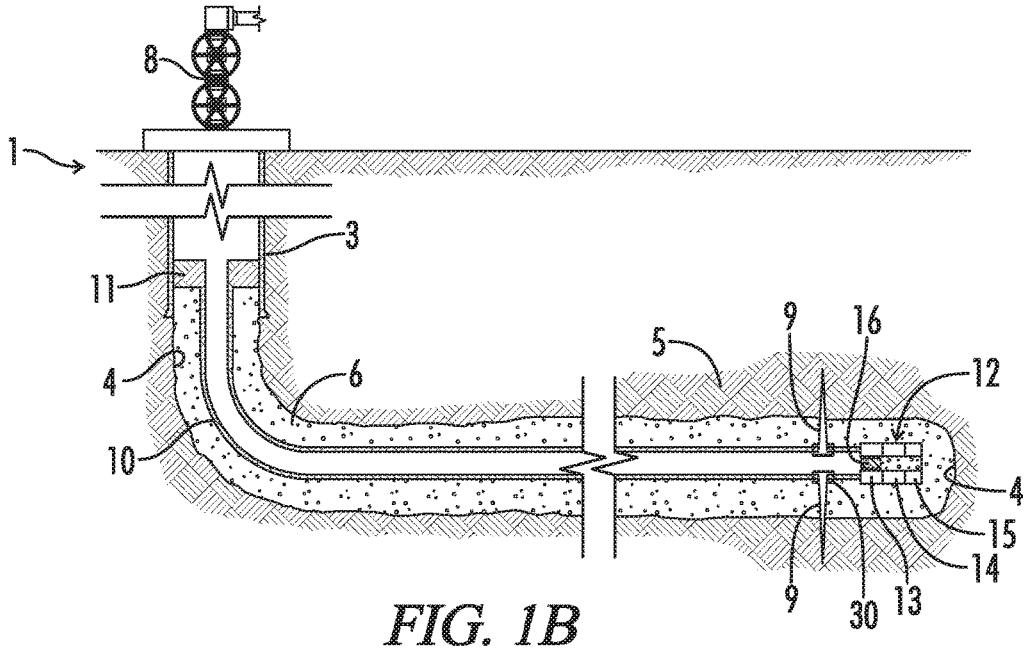

FIG. 1B shows well 1 after the initial stage of a frac job has been completed. Derrick 2 and the cementing equipment have been replaced by well head 8 and other surface equipment (not shown) which will inject frac fluids into well 1 at high pressures and flow rates. Toe valve 30 was run in on liner 10 in its shut position, i.e., with toe valve 30 closed. As discussed in greater detail below, toe valve 30 now has been opened. Fluid has been introduced into formation 5 via open toe valve 30, and fractures 9 extending from toe valve 30 have been created in a first zone near the bottom of well 1.

Figure 1C:
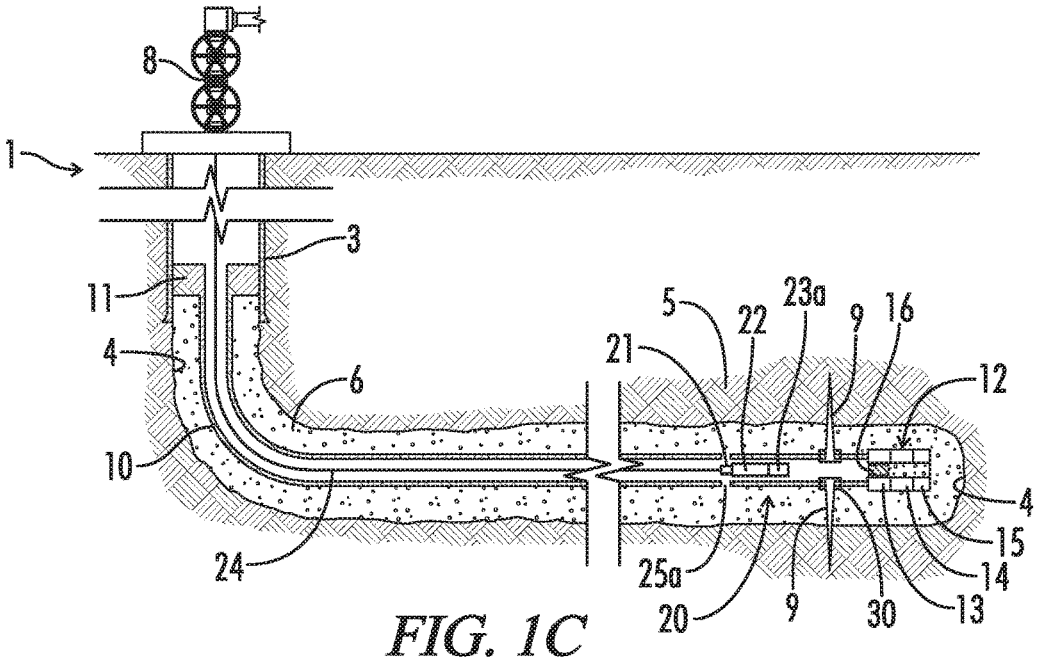
Figure 1D:
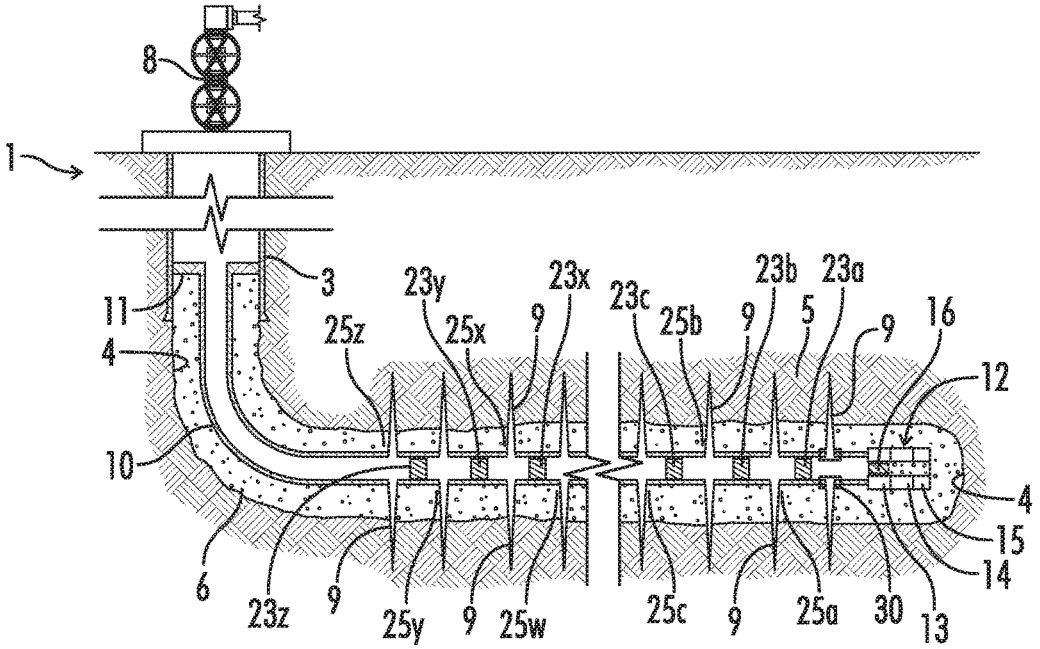

A typical frac job will proceed in stages from the lowermost zone in a well to the uppermost zone. Thus, FIG. 1C shows that a "plug and perf" tool string 20 has been run into liner 10 on a wireline 24. Tool string 20 comprises a perf gun 21, a setting tool 22, and a frac plug 23*a*. Tool string 20 is positioned in liner 10 such that frac plug 23*a* is uphole from toe valve 30. Frac plug 23*a* is coupled to setting tool 22 and will be installed in liner 10 by actuating setting tool 22 via wireline 24. Once plug 23*a* has been installed, setting tool 22 will be released from plug 23*a*. Perf gun 21 then will be fired to create perforations 25*a* in liner 10 uphole from plug 23*a*. Perf gun 21 and setting tool 22 then will be pulled out of well 1 by wireline 24.

A frac ball (not shown) then will be deployed onto plug 23*a* to restrict the downward flow of fluids through plug 23*a*.

Plug 23*a*, therefore, will substantially isolate the lower portion of well 1 and the first fractures 9 extending from toe valve 30. Fluid then can be pumped into liner 10 and forced out through perforations 25*a* to create fractures 9 (shown in FIG. 1D) in a second zone. After fractures 9 have been sufficiently developed, pumping is stopped and valves in well head 2 will be closed to shut in the well 1. After a period of time, fluid will be allowed to flow out of fractures 9, through liner 10 and casing 3, to the surface.

Additional plugs 23*b* to 23*z* then will be run into well 1 and set, liner 10 will be perforated at perforations 25*b* to 25*z*, and well 1 will be fractured in succession as described above until, as shown in FIG. 1D, all stages of the frac job have been completed and fractures 9 have been established in all zones. Once the fracturing operation has been completed, plugs 23 typically will be drilled out and removed from liner 10. Production equipment then will be installed in the well and at the surface to control production from well 1.

The terms "upper" and "lower" and "uphole" and "downhole" as used herein to describe location or orientation are relative to the well and to the tool as run into and installed in the well. Thus, "upper" and "uphole" refers to a location or orientation toward the upper or surface end of the well. "Lower" or "downhole" is relative to the lower end or bottom of the well. It also will be appreciated that the course of the wellbore may not necessarily be as depicted schematically in FIG. 1. Depending on the location and orientation of the hydrocarbon bearing formation to be accessed, the course of the wellbore may be more or less deviated in any number of directions.

"Axial," "radial," "angularly," and forms thereof reference the central axis of the tools. For example, axial movement or position refers to movement or position generally along or parallel to the central axis. "Lateral" movement and the like also generally refers to up and down movement or positions up and down the tool. "Radial" will refer to positions or movement toward or away from the central axis. Since the toe valves are assembled into a liner, their components also may be viewed as having "outer ends" and "inner ends," that is, ends which are situated more toward the connections to the liner and ends that are more toward the inside of the valve.

Overview of First Preferred Toe Valve

As discussed above, the novel toe valves are run into a well in a closed position, but then can be opened to discharge fluid from a liner into a formation to fracture it. Broad embodiments incorporate a hydraulically mounted valve sleeve that has a passage through it which is in fluid communication with the bore. For example, consider preferred novel toe valve 30 which is shown in isolation and in greater detail in FIGS. 2-3. As best appreciated from FIG. 2, toe valve 30 comprises a top sub 31, a bottom sub 32, a housing 33, and a sleeve 34.

Subs 31 and 32 are primary structural components of toe valve 30. They have a generally open cylindrical shape, the outer circumference of which is provided with various profiles. Housing 33 has a generally open cylindrical shape with one or more ports 44. Housing 33 and subs 31 and 32 are threaded together or otherwise assembled and may be viewed as forming the body of toe valve 30. Thus, toe valve 30 has a generally open cylindrical configuration with a tool bore 41 which runs along the primary axis of toe valve 30.

Toe valve 30 is adapted for assembly into liner joints and other tubulars. Top sub 31 and bottom sub 32, therefore, may be provided with conventional features that will allow them to be assembled to tubular joints. For example, the outer ends of sub 31 and 32 may be provided with threads (not shown) which allow them to be assembled into liner 10 by threaded connections. When it is assembled into liner 10, fluids from liner 10 may flow through valve 30 via bore 41, for example, when cementing liner 10 in wellbore 4. As described further below, sleeve 34 may be hydraulically actuated to move from a closed, "run-in" position, to an open, "actuated" position to allow fluid to flow out of valve 30 via ports 44, for example, when fracturing formation 5.

More specifically, and to exemplify the way components of the novel valves may be configured and assembled, it will be appreciated that the outer circumference of top sub 31 and bottom sub 32 are profiled. Both top sub 31 and bottom sub 32 have first portions in which their outer diameter is reduced relative to the nominal outer diameter of toe valve 30. Those first portions, for example, may be provided with outer threads.

Housing 33 may be provided with internal threads at each of its ends. It then may be threaded at one end to top sub 32 and at the other end to bottom sub 32. Preferably, as shown in FIG. 2, the first portion is reduced in diameter an amount approximately equal to the thickness of housing 33 so that the outer circumference of toe valve 30 will be as uniform as possible. It will be noted that the length of housing 33 is coordinated such that top sub 31 and bottom sub 32 are spaced axially apart from each other. In other words, there is an axial gap between the inner ends of top sub 31 and bottom sub 32. Ports 44 in housing 33 are generally aligned radially with that gap.

Top sub 31 and bottom sub 32 also have second portions in which their outer diameter is reduced relative to their nominal outer diameter and relative to the first portions of reduced outer diameter. Those second portions of reduced outer diameter are situated axially inward from the first portions. Thus, when subs 31 and 32 and housing 33 are assembled, the inner ends of subs 31 and 32 are radially spaced from, and are generally concentric with the central portion of housing 33 and ports 44. Subs 31 and 32 and housing 33 thus create an annular clearance or chamber 43 within toe valve 30. Sleeve 34 is hydraulically mounted within chamber 43.

Figure 2A:
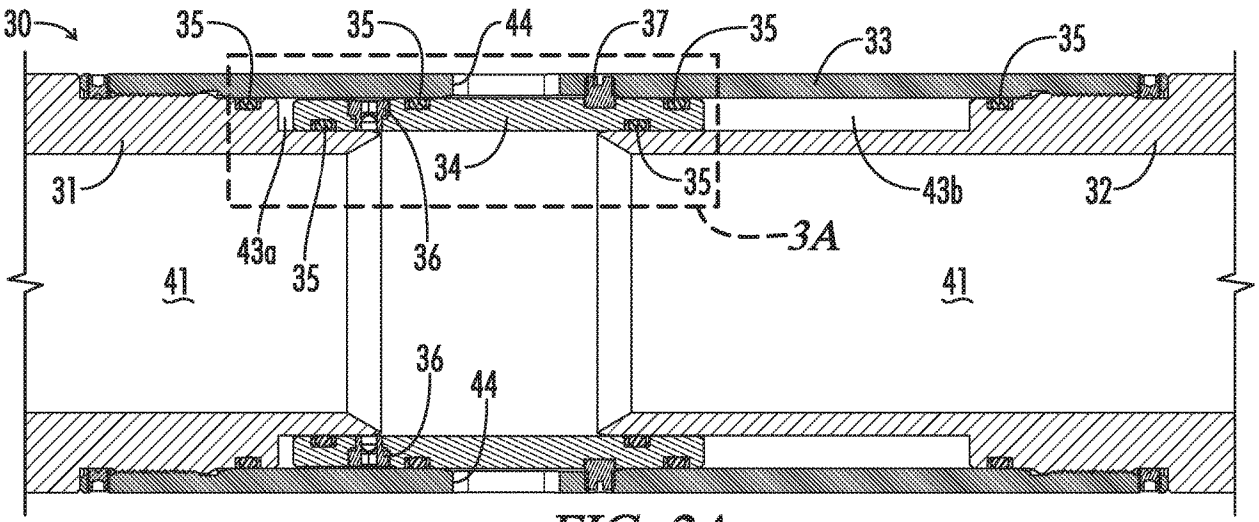
FIGS. 2A and 2B are sequential axial cross-sectional views of toe valve 30 showing, respectively, a central portion of toe valve 30 in its closed, run-in state (FIG. 2A) and in its open, actuated state (FIG. 2B).

Sleeve 34 has a generally open cylindrical shape. When it is in its run-in, closed position, as shown in FIGS. 2A and 3, it extends across ports 44 and across the gap between the inner ends of subs 31 and 32. Fluid is prevented from flowing out of bore 41 through ports 44. Sleeve 34, when it is in its closed position, also divides chamber 43 into an upper chamber 43*a* and a lower chamber 43*b*. Conventional sealing elements, such as O-rings 35, preferably are provided to hydraulically isolate upper and lower chambers 43*a* and 43*b* from the ingress of fluids from bore 41 and from outside of toe valve 30. Preferably, at least one O-ring 35 associated with each chamber 43*a* and 43*b* will provide a "burp" seal, allowing fluid pressure within chambers 43*a* and 43*b* to escape as toe valve 30 is assembled.

The sliding sleeve of the novel toe valves has a passage which allows hydraulic actuation of the sleeve by fluid pressure within the valve bore. For example, sleeve 34 is provided with apertures 42. Apertures 42 are generally cylindrical holes extending radially through sleeve 42 and allow hydraulic communication between bore 41 and upper chamber 43*a*. Toe valve 30 has a pair of apertures 42. They will have at least one, but may have more than two apertures 42 if desired.

As best seen in FIG. 3, at their outer terminus, what may be referred to as their outlet, apertures 42 communicate with upper chamber 43*a* via a radial clearance between the outer surface of sleeve 34 and the inner surface of housing 33. The clearance is created by a slight reduction in the outer diameter of sleeve 34, but it may be created by an enlargement in the inner diameter of housing 33 or by other profiles in sleeve 34 or housing 33. A passage also may extend through sleeve 34 directly to upper chamber 43*a*.

The inner terminus or inlet of apertures 42 communicates with bore 41. Preferably, apertures 42 communicate with bore 41 via a radial clearance between the inner surface of sleeve 34 and the outer surface of upper sub 31. For example, and again as seen best in FIG. 3, a clearance is provided by a slight taper on the outer circumference of the inner end of top sub 31. A clearance, however, may be created by an enlargement of the inner diameter of sleeve 34 or by other profiles in either sleeve 34 or upper sub 31. The passage also may open into and communicate directly with bore 41, but as will be discussed below, preferably it does not.

The sleeve passages in the novel toe valves preferably are provided with pressure release devices that restrict flow through the passage unless and until pressure within the bore exceeds a predetermined level. For example, apertures 42 preferably are threaded and profiled to accommodate rupture discs 36. Rupture discs 36 provides a rupturable closure which blocks flow through apertures 42 when toe valve 30 is in its closed state.

Rupture discs 36 are mounted in apertures 42, for example, by a threaded connection. Elastomeric seals, seats, or other sealing members (not shown) may be provided to enhance the seal between rupture discs 36 and apertures 42. It will be appreciated, however, that rupture discs 36 may be mounted in a variety of ways such that they block fluid from flowing through apertures 42. Other pressure release devices also may be provided in the sleeve passage, such as check valves and pressure relief valves. In any event, rupture discs or other pressure relief devices allow the novel toe valves to be actuated in response to a predetermined hydraulic pressure in the valve bore.

Figure 2B:
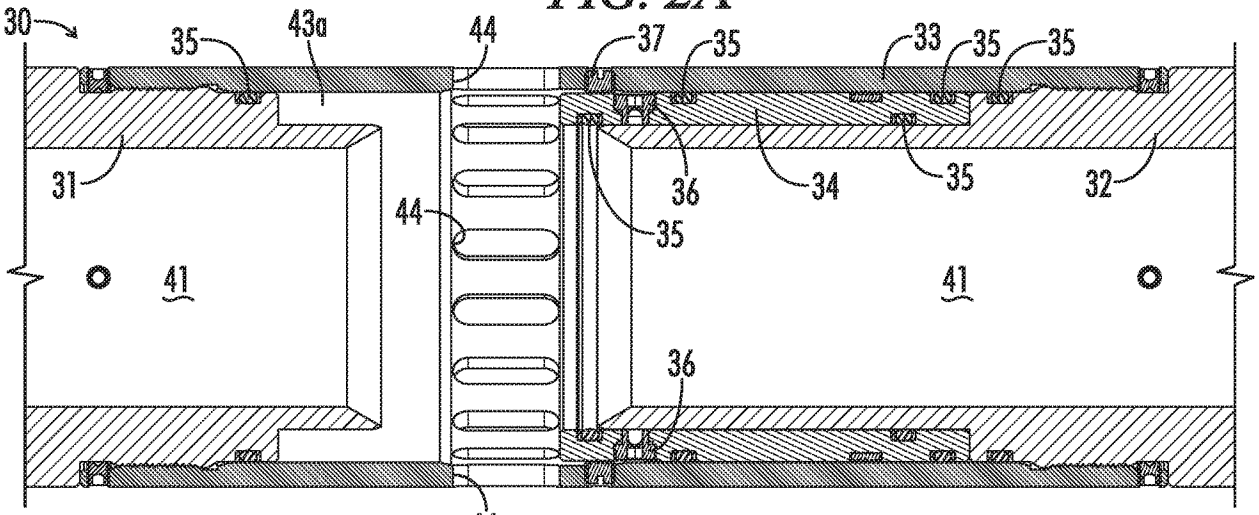
Figure 3A:
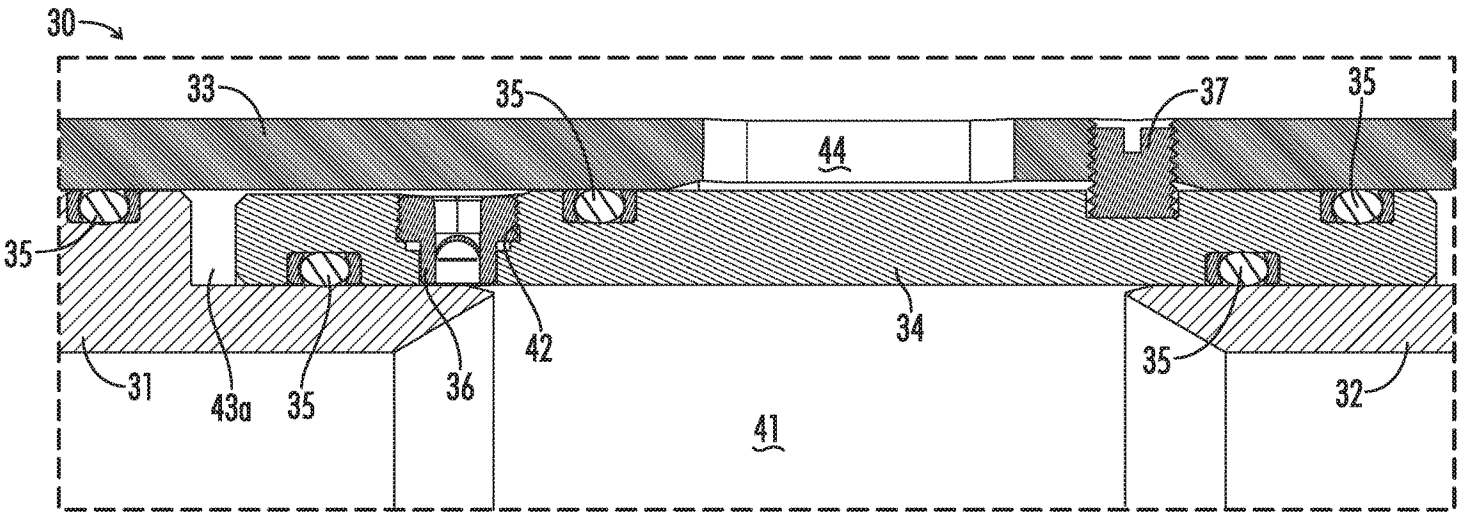
FIG. 3A is an enlarged view of toe valve 30 taken in area 3A of FIG. 2A showing details of toe valve 30 in its closed, run-in state.
Figure 3B:
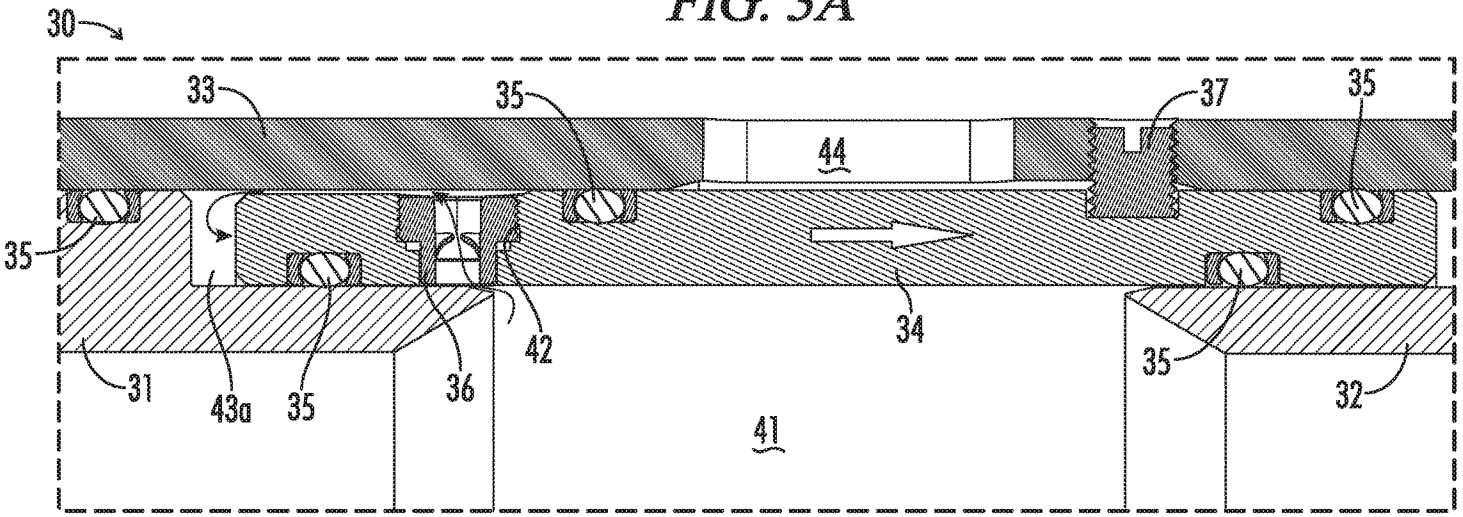
FIG. 3B is an enlarged view of toe valve 30 like FIG. 3A, except that a rupture disc 36 has been ruptured.

For example, as will be appreciated by comparing FIGS. 3A and 3B, pressure may be increased within bore 41. Rupture discs 36, because they are in hydraulic communication with bore 41, will "see" the same pressure. Both upper chamber 43*a* and lower chamber 43*b* have low internal pressures, at least lower chamber 43*a* preferably being filled only with air captured during assembly of toe valve 30. When the pressure in bore 41 exceeds their rated pressure, as illustrated in FIG. 3B, rupture discs 36 will rupture and allow fluid to flow through apertures 42 and into upper chamber 43*a*. As fluid enters upper chamber 43*a*, sleeve 34 will be urged downward until its upper end sees the pressure in bore 41. From that point on, hydraulic pressure within bore 42 will bear directly on sleeve 34 until, as shown in FIG. 2B, it has uncovered ports 44 and moved substantially completely into lower chamber 43*b*. Fluid then will be able to exit bore 41 and toe valve 30 via ports 44 to, for example, fracture formation 5 in the vicinity of toe valve 30 as shown schematically in FIG. 1C.

It will be appreciated that by utilizing a passage through the sleeve to establish fluid communication from the bore to the hydraulic chamber, the novel toe valves may open more reliably. For example, as shown in FIG. 2, when sleeve 34 is in its closed position, bore 41 of toe valve 30 has a relatively smooth, profile-free inner diameter apart from a tapered enlargement between the inner ends of subs 31 and 32. Thus, it is expected that a wiper plug, such as wiper plug 16, can more effectively remove cement from toe valve 30 when liner 10 is cemented in well 1. Moreover, as may be seen best in FIG. 3, apertures 42 and rupture discs 36 in sleeve 34 are covered by upper sub 31. That is, the inner end of upper sub 31 is situated radially inward and over substantially the entire inlet of rupture discs 36 mounted in apertures 42. The inlet to rupture discs 36 are substantially protected from the ingress of cement during cementing operations. Thus, it is expected that rupture discs 36 will more reliably rupture at their rated pressure and, in turn, that toe valve 30 may be opened more reliably.

Toe valve 30 has 18 ports arrayed angularly about housing 33, each separated by 20° and each having a generally oval shape. Different numbers of ports 44, however, and different arrays may be employed. Likewise, ports 44 may have other shapes, such as elliptical or circular. The geometries of ports 44 also may vary within a single embodiment. The precise configuration and arrangement of the ports may be varied in ways well known in the art, for example, to provide a desired fracture pattern.

Once opened, ports 44 also will allow hydrocarbons to flow from formation 5 into liner 10 and thence to the surface. Thus, retention mechanisms may be provided to hold sleeve 34 in its open position so that production is not impeded. For example, toe valve 30 may be provided with a ratchet ring (not shown) mounted within lower chamber 43*b* along the inner diameter of housing 33 or the outer diameter of bottom sub 32. The ratchet ring provides pawls which can engage a series of detents provided on sleeve 34. The ratchet ring is a split ring, allowing it to compress circumferentially, depressing the pawls and allowing them to pass over the detents on sleeve 34 as it moves downward in lower chamber 43*b*. The pawls on the ratchet ring are ramped into engagement with the detents, however, if there is any upward travel of sleeve 34. A variety of such ratchet mechanisms are known, however, and may be used, as may other conventional retention mechanisms. For example, the end of sleeve 34 may be provided with tapers, and corresponding tapers provided in bottom sub 32 and housing 33 such that sleeve 34 self-locks into the bottom of lower chamber 43*b*.

Similarly, a mechanism may be provided to hold sleeve 34 in its closed position so that it does not open prematurely as it is being run into or installed with well 1. For example, toe valve 30 is provided with one or more shear screws 37. Shear screws 37 are screwed into threaded holes passing through housing 33. They extend into bottomed holes in the outer circumference of sleeve 34, thus holding sleeve 34 in place. Screws 37 will shear and release sleeve 34 when the load on sleeve 34 exceeds a rated force. Other types of shearable members, however, may be used, as may other mechanisms for releasably retaining sleeve 34.

Preferred toe valve 30 has been disclosed and described as being assembled from a number of separate components. Workers in the art will appreciate that certain of those components and other tool components may be fabricated as separate components, or may be combined and fabricated as a single component if desired. For example, the body of toe valve 30 has been described as assembled from three major components: upper sub 31, lower sub 32 and housing 33. Those components allow toe valve 30 to be easily and reliably assembled. The body, however, may be assembled from fewer components. A housing may be formed integrally with one of the subs, or the subs could be formed as an integral component. The components also may be split into separate components. Other modifications of this type are within the skill of workers in the art and may be made to facilitate fabrication, assembly, or servicing of the valves or to enhance its adaptability in the field.

In general, the novel toe valves may be fabricated from materials typically used in valves of this type. Given the extreme stress and the corrosive and abrasive fluids to which toe valves are exposed, suitable materials will be hard and strong. For example, excepting their seals, the components of novel toe valves may be fabricated from 4130 and 4140 chromoly steel or from somewhat harder, stronger steel such as 4130M7, high end nickel alloys, and stainless steel. The components may be made by any number of conventional techniques, but typically and in large part will be made by forging, extruding, or mold casting a blank part and then machining the required features into the part.

Rupture disc 36 preferably is fabricated from metal, such as stainless steel grade 316, Inconel® (nickel alloy 600), Monel®, (nickel alloy 400), Hastelloy® C-276, and other steel alloys. Other metals may be used, however, as desired. High tensile strength engineering plastics also may be used, such as polycarbonates and Nylon 6, Nylon 66, and other polyamides, including fiber reinforced polyamides such as Reny polyamide. "Super" engineering plastics, such as polyether ether ketone (PEEK) and polyetherimides such as Ultem® may be particularly suitable.

It will be noted that disc 36 is a forward acting or tension type rupture disc. That is, load is applied to a concave side of disc 36 and the tensile strength of disc 36 determines burst pressure. Flat tension discs may be used, as may be reverse action rupture discs. In reverse action discs pressure is applied against a convex side of the disc, placing the disc under compression. The load strength of the disc determines burst pressure. Disc 36 also, as is typical, may include various scoring patterns to control the way in which the disc ruptures. For example, scores may be used to create one or more hinges such that debris from the disc is not carried along with fluid.

The novel valves have been described as being assembled into a liner and, more specifically, a production liner used to fracture a well in various zones along the wellbore. A "liner," however, can have a fairly specific meaning within the industry, as do "casing" and "tubing." In its narrow sense, a "casing" is generally considered to be a relatively large tubular conduit, usually greater than 4.5" in diameter, that extends into a well from the surface. A "liner" is generally considered to be a relatively large tubular conduit that does not extend from the surface of the well, and instead is supported within an existing casing or another liner. In essence, it is a "casing" that does not extend from the surface. "Tubing" refers to a smaller tubular conduit, usually less than 4.5" in diameter. The novel valves, however, are not limited in their application to liners as that term may be understood in its narrow sense. They may be used to advantage in liners, casings, tubing, and other tubular conduits or "tubulars" as are commonly employed in oil and gas wells.

Likewise, while the exemplified toe valves are particularly useful in fracturing a formation and have been exemplified in that context, they may be used advantageously in other processes for stimulating production from a well. For example, an aqueous acid such as hydrochloric acid may be injected into a formation to clean up the formation and ultimately increase the flow of hydrocarbons into a well. In other cases, "stimulation" wells may be drilled near a "production" well. Water or other fluids then would be injected into the formation through the stimulation wells to drive hydrocarbons toward the production well. The novel toe valves may be used in all such stimulation processes where it may be desirable to create and control fluid flow in defined zones through a wellbore. Though fracturing a wellbore is a common and important stimulation process, the novel toe valves are not limited thereto.

The novel toe valves also have been exemplified in certain types of cementing operations. There are, however, many different methods and tools for cementing liners. The novel toe valves in general may be adapted for use in any such conventional operations. Moreover, while the novel toe valves are particularly useful when the liner will be cemented in the well, they may be used when the liner has not or will not be cemented, that is, in so-called open hole wells.

While this invention has been disclosed and discussed primarily in terms of specific embodiments thereof, it is not intended to be limited thereto. Other modifications and embodiments will be apparent to the worker in the art.

What is claimed is:

1. A toe valve, comprising:

(a) a bore extending through said valve;

(b) a first sub having an inner end;

(c) a second sub having an inner end;

(d) a housing, said housing:

i) having a port; and ii) coupling said first and second subs such that said inner ends of said subs are spaced apart axially, and said housing is spaced radially from said inner ends of said subs; and (e) a sleeve, said sleeve:

i) being mounted for hydraulic displacement in said radial space between said housing and said inner ends of said subs; and ii) having a passage extending radially through the wall of said sleeve and in fluid communication with said bore and said axial space between said inner ends of said subs;

(f) wherein said sleeve is moveable in response to fluid pressure from said bore through said passage, said sleeve being movable from a closed position, in which said sleeve restricts flow out of said bore through said port, to an open position, in which said sleeve allows flow out of said bore through said port.

2. The toe valve of claim 1, wherein said sleeve passage is covered by said first sub when said sleeve is in said closed position.

3. The toe valve of claim 2, wherein a radial clearance between said sleeve and said first sub provides fluid communication between said sleeve passage and said axial space between said inner ends of said subs.

4. A method of performing a well operation, said method comprising:

(a) providing a liner assembly comprising a toe valve of claim 3;

(b) increasing hydraulic pressure in said liner assembly to open said toe valve and discharge fluids from said liner assembly through said toe valve.

5. A method of performing a well operation, said method comprising:

(a) providing a liner assembly comprising a toe valve of claim 2, (b) increasing hydraulic pressure in said liner assembly to open said toe valve and discharge fluids from said liner assembly through said toe valve.

6. The toe valve of claim 1, wherein a radial clearance between said sleeve and said first sub provides fluid communication between said sleeve passage and said axial space between said inner ends of said subs.

7. The toe valve of claim 1, wherein said inner end of each of said first and second subs comprises a portion of reduced outer diameter and wherein said housing is spaced radially outward from said portions of reduced outer diameter.

8. The toe valve of claim 1, wherein said inner end of each said first and second subs comprise a portion of a first reduced outer diameter and a portion of a second reduced outer diameter; and wherein said housing is coupled to said inner ends of said subs at said portions of first reduced outer diameter and is spaced radially outward from said portions of second reduced outer diameter.

9. The toe valve of claim 1, wherein said housing couples said subs by threaded connections.

10. The toe valve of claim 1, wherein said sleeve comprises a pressure release device disposed in said passage.

11. The toe valve of claim 10, wherein said pressure release device is a rupture disc, check valve, or pressure relief valve.

12. The toe valve of claim 10, wherein said pressure release device is a rupture disc.

13. The toe valve of claim 10, wherein said pressure release device is covered by said first sub when said sleeve is in its said closed position.

14. The toe valve of claim 1, wherein said sleeve is releasably retained in the open position.

15. The toe valve of claim 14, wherein said sleeve is releasably retained in the open position by a lock ring engaging one of said subs and said sleeve.

16. The toe valve of claim 14, wherein said sleeve is releasably retained in the open position by self-locking tapers.

17. A method of performing a well operation, said method comprising:

(a) providing a liner assembly comprising a toe valve of claim 1;

(b) increasing hydraulic pressure in said liner assembly to open said toe valve and discharge fluids from said liner assembly through said toe valve.

18. A toe valve, comprising:

(a) a valve body comprising a sub;

(b) a bore extending through said valve: body and said sub;

(c) a port; and (d) a sleeve, said sleeve:

i) being mounted for hydraulic displacement; and ii) having a passage through said sleeve and in fluid communication with said bore;

(e) wherein said sleeve is moveable in response to fluid pressure from said bore through said passage, said sleeve being movable from a closed position, in which said sleeve restricts flow out of said bore through said port, to an open position, in which said sleeve allows flow out of said bore through said port; and (f) wherein said passage is covered by said sub when said sleeve is in its said closed position.

19. The toe valve of claim 18, wherein a radial clearance between said sleeve and said sub provides fluid communication between said sleeve passage and said bore.

20. A method of performing a well operation, said method comprising:

(a) providing a liner assembly comprising a toe valve of claim 19;

(b) increasing hydraulic pressure in said liner assembly to open said toe valve and discharge fluids from said liner assembly through said toe valve.

21. The toe valve of claim 18, wherein said sleeve comprises a pressure release device disposed in said passage.

22. The toe valve of claim 21, wherein said pressure release device is a rupture disc.

23. A method of performing a well operation, said method comprising:

(a) providing a liner assembly comprising a toe valve of claim 18;

(b) increasing hydraulic pressure in said liner assembly to open said toe valve and discharge fluids from said liner assembly through said toe valve.

24. The toe valve of claim 19, wherein said sleeve comprises a pressure release device.

* * * * *